US005226494A

United States Patent [19]

Rubbo et al.

[11] Patent Number: 5,226,494

[45] Date of Patent: Jul. 13, 1993

[54] SUBSURFACE WELL APPARATUS

[75] Inventors: Richard P. Rubbo, The Woodlands; Daniel S. Bangert, Kingwood, both of Tex.

[73] Assignee: Baker Hughes Incorporated, Houston, Tex.

[21] Appl. No.: 873,654

[22] Filed: Apr. 23, 1992

Related U.S. Application Data

[63] Continuation of Ser. No. 784,666, Oct. 24, 1991, which is a continuation of Ser. No. 549,803, Jul. 9, 1990.

[51] Int. Cl.[5] ..... E21B 34/10

[52] U.S. Cl. ..... 166/250; 166/374; 166/66.4

[58] Field of Search ..... 166/55.1, 65.1, 66.4, 166/72, 122, 187, 242, 250, 373, 374, 381, 387; 175/4.52, 4.54; 73/151, 714, 726; 367/81, 83; 340/465, 853; 116/DIG. 7, 212

[56] References Cited

U.S. PATENT DOCUMENTS

| | | | |
|---|---|---|---|
| 3,570,594 | 3/1971 | Hamilton . | |
| 3,737,845 | 6/1973 | Maroney et al. . | |
| 3,855,853 | 12/1974 | Claycomb | 175/40 |
| 3,971,317 | 7/1976 | Gemmell et al. . | |
| 4,367,794 | 1/1983 | Bednar et al. | 166/373 |
| 4,572,288 | 2/1986 | Kinley . | |
| 4,636,934 | 1/1987 | Schwendemann et al. . | |
| 4,796,699 | 1/1989 | Upchurch . | |
| 4,805,449 | 2/1989 | Das | 175/48 |
| 4,856,595 | 8/1989 | Upchurch . | |
| 4,886,126 | 12/1989 | Yates, Jr. | 166/65.1 |
| 4,896,722 | 1/1990 | Upchurch | 166/65.1 |
| 4,903,245 | 2/1990 | Close et al. . | |
| 4,915,168 | 4/1990 | Upchurch | 166/66.4 |
| 4,941,951 | 7/1990 | Sheppard et al. | 175/48 |

OTHER PUBLICATIONS

G. E. Findlay, et al. International Journal of Pressure Vessels and Piping, "Local Radial Loads on Cylinders: BS5500 Predictions Versus Experimental Results", vol. 27, (1987), pp. 33-38.

H. D. Gerlach, International Journal of Pressure Vessels and Piping, "Optimized Pressure Vessel Design with Special Respect to Operating Conditions", vol. 31, (1988), pp. 285-293.

E. C. Rodabaugh, et al. Pressure Vessels and Piping: Design and Analysis-A Decade of Progress, "Effect of Internal Pressure on Flexibility and Stress-Intensification Factors of Curved Pipe or Welding Elbows", pp. 1165-1174.

Edward D. Esparza, Experimental Techniques, "Measurement of Transient Stresses", Dec. 1984, pp. 29-38.

Pieter J. Sevenhuijsen, Experimental Technique, "Stress Gages", Mar. 1984, pp. 26-27.

L. J. Hosaluk, et al., Experimental Techniques, "Strain-Gage Methods for Hydrostatic Testing of Prototype Nuclear-Fuel Waste-Disposal Containers", Jul. 1986, pp. 14-17.

Lloyd R. Foss, Experimental Techniques, "A Method for Measuring End Load in a Pressurized Hollow Rod", Jul. 1983, p. 24.

A. Y. Kandell, et al., Experimental Techniques, "Indirect Pressure Measurement for Functionally Inaccessible Vessels", Jan. 1989, pp. 18-21.

Alwyn S. Tooth, et al., Strain, "The Derivation of the Stresses in a Pressurised Pipe or Cylindrical Vessel with Initial Geometric Imperfections", Feb. 1988, pp. 7-14.

Peter Gawthorpe, Strain, "Pressure Vessel Proof Testing-The British Standard", Jan. 1979, pp. 12-13.

(List continued on next page.)

*Primary Examiner*—Ramon S. Britts
*Assistant Examiner*—Frank S. Tsay
*Attorney, Agent, or Firm*—Melvin A. Hunn

[57] ABSTRACT

Method and apparatus for actuating one or more downhole well tools carried by a production or work string conduit having an imperforate wall and for blocking fluid communication between an activating fluid body and a second fluid source within said well across dynamic seals between actuating members of the well tool, by producing selective signals through the conduit wall detectable by a member to produce an activating signal for actuating the downhole well tool by a downhole energy source.

23 Claims, 5 Drawing Sheets

OTHER PUBLICATIONS

R. Kitching, et al., The Journal of Strain Analysis, "Analysis of Stresses in a Limpet-Coil Pressure Vessel Due to Pressure in the Coil", Jul. 1974, pp. 172-177.

M. Holland, et al., The Journal of Strain Analysis, "Reinforced Discontinuous Bend Subjected to Uniform Internal Pressure: Effect of Reinforcing Ring Stiffness", Apr. 1973, pp. 77-82.

R. Kithching, et al., The Journal of Strain Analysis, "Out-of-Circularity Effects in a Pipe Bend Subjected to Pressure and Bending Loads", Oct. 1972, pp. 294-302.

M. P. Bond, et al., The Journal of Strain Analysis, "Stress and Flexibility Factors for Multi-Mitred Pipe Bends Subjected to Internal Pressure Combined With External Loadings", Apr. 1972, pp. 97-108.

A. S. Tooth, et al., The Journal of Strain Analysis, "Stresses in Horizontal Storage Vessels-A Comparison of Theory and Experiment", Jul. 1982, pp. 169-176.

D. R. Wassermann, The International Journal of Pipe Vessels and Piping, "Experimental Investigation of Stresses in Cold-Bent Pipes Due to Internal Pressure and In-Plane Bending", vol. 14, No. 3, 1983, pp. 135-151.

S. R. McNeill, et al., The International Journal of Pipe Vessels and Piping, "Stress Analysis of a Reversed Disk Head of a Cylindrical Pressure Vessel", vol. 18, No. 2, 1985, pp. 81-90.

I. W. Hornby, The International Journal of Pipe Vessels and Piping, "The Strain Behavior of a Pre-Stressed Concrete Reactor Vessel After Twelve Years of Operation", Jan.-Feb. 1980, pp. 25-40.

C. D. Miller, et al., The International Journal of Pipe Vessels and Piping, "Pressure Testing of Large Scale Torispherical Heads Subject to Knuckle Buckling", vol. 22, No. 2, 1986, pp. 147-159.

Helmut Zemann, et al., The International Journal of Pipe Vessels and Piping, "In Service Supervision of a Prestressed Concrete Pressure Vessel", vol. 21, No. 2, 1985, pp. 121-156.

N. J. I. Adams, The International Journal of Pipe Vessels and Piping, "A Theoretical and Experimental Investigation of Stress and Stiffness Coefficients for Low Entry Nozzles in Bulk Liquid Cylindrical Storage Tanks", vol. 19, No. 2, 1985, pp. 133-159.

B. E. Rossi, Experimental Mechanics: Proceedings of the First International Congress on Experimental Mechanics Held In New York, Nov. 1-3, 1961, "Pressure Technique for Determining Residual Stresses in Circular Tubes", pp. 371-381.

R. Royles et al., Experimental Mechanics, "Buckling Behavior of an Underwater Storage Vessel", Dec. 1985, pp. 421-428.

C. C. Perry, Experimental Mechanics, "The Resistance Strain Gage Revisited", Dec. 1984, pp. 286-299.

M. T Flaman, et al., Experimental Mechanics, "Measurement of Stresses, Forces, and Moments on Nuclear Steam Gnerators", Mar. 1983, pp. 10-14.

J. F. Throop, Experimental Mechanics, "Strain Behavior of Pressurized Cracked Thick-Walled Cylinders", Aug. 1982, pp. 277-286.

C. L. Chow, et al., Experimental Mechanics, "The Effect of Inflation Pressure and Vehicle Loading on the Sidewall of A Radial Tire", Oct. 1981, pp. 379-385.

H. S. Freynik, et al., Experimental Mechanics, "Measuring Small Internal Pressure Along a Tube During Steady Flow", Nov. 1977, pp. 415-419.

J. F. Field, et al., Experimental Mechanics, "Stress Concentrations Around Multiple Windows in a High Pressure Vessel", Jun. 1977, pp. 223-227.

J. D. Vasilakis et al., Experimental Mechanics, "High Temperature Test Facility for Repeated Pressure Loadings of Cylinders", Jul. 1976, pp. 270-272.

M. C. Collins et al., Experimental Mechanics, "Surface Strain Measurements on a Hemispherical Shell Using Holographic Interferometry", Apr. 1975, pp. 128-132.

T. J. David, Experimental Mechanics, "Strain Measurements on Steam Turbines", Apr. 1971, pp. 185-192.

B. Roberts et al., Experimental Mechanics, "Testing of Large Piping Components Under Mechanical and Pressure Loadings", Apr. 1971, pp. 178-184.

P. D. Flynn, et al., Experimental Mechanics, "A Simple Transducer for Detecting Projectiles in Gun Barrels", Aug. 1973, pp. 350-352.

P. D. Flynn, Experimental Mechanics, "Some Strain--Gage Applications to Ballistic Problems", Jul. 1970, pp. 297-304.

J. H. Heifetz et al., Experimental Mechanics, "Measurements of Stress Concentration Factors in the External Fillets of a Cylindrical Pressure Vessel", Dec. 1967, pp. 518-524.

(List continued on next page.)

OTHER PUBLICATIONS

J. L. Schlafer et al., Experimental Mechanics, "Experimental Evaluation of Incremental Theories for Nonproportionate Loading of Thin Walled Cylinders", Nov. 1969, pp. 500-506.

B. L. Greenstreet et al., Experimental Mechanics, "Experimental Stress Analysis of a Nuclear Reactor Pressure Vessel", Jun. 1963, pp. 129-139.

D. E. Hardenbergh et al., Experimental Mechanics, "Stresses at Nozzle Corrections of Pressure Vessels", May 1961, pp. 152-158.

W. C. Fok et al., The International Journal of Pressure Vessels and Piping, "On the Evaluation of the Mechanical Properties and the Ultimate Internal Pressure of a Thin-Walled Closed-End Cylinder", vol. 38, No. 2, 1989, pp. 160-165.

B. Flesch, et al., The International Journal of Pipe Vessels and Piping, "Leak-Before-Break in Steam Generator Tubes", vol. 43, No. 1-3, (1990).

M. Gafitanu, et al., The International Journal of Pipe Vessels and Piping, "Measurement Errors Resulting from the Strain Gauge Integration Effect", vol. 41, No. 2, (1990), pp. 127-139.

H. Joas, 5th International Conference on Pressure Vessel Technology, "Design and Analysis", Sep. 9-14, 1984, vol. 1, pp. 96-105.

Yan Huang, et al., 5th International Conference on Pressure Vessel Technology, "Design and Analysis", 1984, vol. 1, pp. 144-149.

B. Tomkins, Second International Conference on Pressure Vessel Technology, "Materials, Fabrication and Inspection", 1973 pp. 835-847.

M. Terao, et al., Second International Conference on Pressure Vessel Technology, "Materials, Fabrication and Inspection", 1973, pp. 753-771.

B. Tomkins, The International Journal of Pipe Vessels and Piping, "Fatigue Failure Criteria for Thick-Walled Cylindrical Pressure Vessels", Jan. 1973, pp. 37-59.

F. H. Erbatur et al., The International Journal of Pipe Vessels and Piping, "Plastic Behaviour of Oblique Flush Cylindrical Nozzles in Cylindrical Pressure Vessels: An Experimental Investigation", Dec. 1972, pp. 93-118.

R. L. Brockenbrough, Journal of Pressure Vessel Technology, "Fatigue Life of Seamless Steel Pressure Vessels", Aug. 1987, pp. 323-328.

N. C. Huang, et al., Journal of Pressure Vessel Technology, "Collapse of Oil Well Casing", vol. 104, Feb. 1982, pp. 36-41.

A. H. Van Der Krogt, Journal of Pressure Vessel Technology, "Mathematical and Experimental Investigation Into the Auto-Frettaging of High-Pressure Mudpump Fluid Ends", Feb. 1978, vol. 100, pp. 39-45.

S. J. Brown, Jr., et al. Journal of Pressure Vessel Technology, "Analytical and Experimental Stress Analysis of a Cylinder-to-Cylinder Structure", Nov. 1977, pp. 575-583.

E. B. Denison, Journal of Pressure Vessel Technology, "Downhole Measurements Through Modified Drill Pipe", May 1977, pp. 374-379.

C. M. Romander, et al., Journal of Pressure Vessel Technology, "Response of Water-Filled Thin-Walled Pipes to Pressure Pulses: Experiments and Analysis", vol. 102, Feb. 1980, pp. 56-61.

D. Redekop et al., Journal of Pressure Vessel Technology, "Approximate Prediction of Hoop Stresses at Major Sections of Tee Intersections of Cylindrical Shells Subjected to Internal Pressure", vol. 101, Aug. 1979, pp. 186-193.

F. A. Simonen, et al., Journal of Pressure Vessel Technology "Analysis of Strength and Residual Stresses in Filament Reinforced Aluminum Cylinders", Aug. 1975, pp. 192-198.

John F. Harrey, Theory and Design of Modern Pressure Vessels, Second Edition, Van Nostrand Reinhold Company, 1974 pp. 38-47.

Anthony Lawrence Kohan, "Pressure Vessel Systems", McGraw-Hill Book Company, 1987, pp. 162-177.

SUBSURFACE WELL APPARATUS

This application is a continuation of application Ser. No. 07/784,666, filed Oct. 24, 1991 which is a continuation of application Ser. No. 549,803, filed Jul. 9, 1990.

BACKGROUND OF THE INVENTION

1. Field of the Invention

The present invention relates to subsurface well apparatus and more particularly to the remote operation of subterranean well tools.

2. Summary of the Prior Art

Subsurface well tools have been operated in the past by a wide variety of mechanisms. Manipulation of the tubing string, such as push and/or pull, tubular rotation, and the like, is one of the more common methods employed, but can be difficult to accurately accomplish in deep or deviated wells. Other actuation means include use of hydraulic/hydrostatic members, pneumatic elements, as well as radio and other surface and subsurface-initiated electronic components.

Typical of subterranean well tools actuated by such procedures include bridge plugs, packers, perforating guns, tubing hangers, safety and other valves, test trees, and the like, all of which are contemplated for use with the present invention. Such tools require actuation procedures, such as setting at correct depth in the well and at a particular time during the completion operation, unsetting in response to a given well condition or event, re-setting, opening, closing or throttling flow paths, perforating casing, and the like.

In the normal operation of a well wherein the production tubing or work string is installed or being installed, and the tools are to be activated by hydraulic means incorporating fluid and pressure within the production or work string, it is very common to provide one or more ports in the wall of the production tubing or work string, or a component in direct fluid communication therewith, to provide actuating fluid from the bore of the production tubing to well tools to initiate the desired operation, such as the setting of a packer. It has been found that such openings provided in the wall of the production tubing or work string are highly undesirable because such openings must be effectively sealed against any leakage of any fluids subsequently carried through the tubing, such as the produced well fluids. Seals that are employed in and between operating components of well tools, such as pistons and housings therefor, are subject to deterioration, hence leakage, because of the high temperature, high pressure environment in which such seals are required to operate regardless of whether such seals are elastomeric, metallic, or any other commonly used structures. This is particularly true of the seals employed on actuating pistons for packers, safety valves or similar downhole tools wherein an actuating fluid is applied to one side of the piston and the other side of the piston is exposed to well fluids, atmospheric pressure, or the like. Deterioration of the seals on such actuating member expose such components to undesirable leakage of either actuating fluid or production or other fluids, depending on the relative pressures, around the piston, or other actuating component, thus initially creating a microannulus therethrough. Such micro-annulus leak path could be serious enough to subject the well to a blow out.

The utilization of a downhole energy source which can be transformed into kinetic energy by the provision of a triggering signal to operate a well tool is disclosed in U.S. Pat. No. 3,233,674. In the illustrated device thereof, the downhole source of energy is an explosive charge which is discharged and the resulting gas is applied to a piston which functions to set a hanger in a well casing. The triggering signals for energizing the downhole circuitry for effecting the discharge of the explosive charge is produced by a pair of sonic frequency generators which are located at the surface and which are transmitted downhole through well fluids or a tubing string, or can be packaged with a suitable power supply container that is lowered into the well on wireline or cable.

One problem with apparatus constructed in accordance with U.S. Pat. No. 3,233,674, is that the acoustical signals employed for effecting the triggering of the downhole source of energy must be coded in order to prevent inadvertent operation of the device by the static normally encountered in the transmission of acoustic signals either through the well fluids or through the body of a tubular conduit. The employment of coded alternating signals necessarily complicates the electronic pickup circuitry which must be designed so as to distinguish between static signals and the proper coded signal.

U.S. Pat. No. 4,896,722 discloses another approach to energization of a downhole source of energy. In the apparatus illustrated in this patent, the hydrostatic pressure of well fluids in the well annulus acts on a floating piston to provide the source of downhole energy. Such energy is employed to effect the opening and closing of a test valve which is normally utilized in the lower end of a string of drill stem testing tools. The hydrostatically pressurized oil acts on one side of a piston which is opposed on its opposite side by air at atmospheric or other low pressure. The piston is prevented from movement by a spring until a predetermined hydrostatic annulus pressure is obtained. A pair of solenoid controlled valves controls the hydrostatic pressure acting on the floating piston. The two solenoid control valves are in turn controlled by a microprocessor which operates in response to a pressure transducer which is exposed to annulus pressure and provides an electrical signal output indicative thereof. Again, however, the signals applied to the pressure transducer are in the nature of a series of low level pressure pulses, each having a specified duration. Such pulses are applied at the well surface to the fluids standing in the well annulus. Thus, the detection circuitry which picks up the signals is complicated because it has to be designed to respond to only a specific series of low level pressure pulses.

The prior art has not provided an actuating system for a downhole well tool which does not require ports in the production tubing or work string or component in fluid communication therewith, and which may be reliably controlled from the surface through the utilization of control forces through the wall of the production tubing or work string to produce an activating signal for actuating the downhole well tool by a downhole energy source and to block fluid communication between an actuating fluid body and a second fluid source within said well across dynamic seals between actuating members of the well tool.

SUMMARY OF THE INVENTION

The method and apparatus of this invention may be employed for the actuation of any one or more downhole tools, such as packers, safety valves, testing valves, perforating guns, and the like. The apparatus employed in the invention contemplates a production tubing or work string portion extendable to a tubular conduit string extending from the earth surface down into contact with the well fluids existing in the well. The wall of such production tubing is imperforate throughout its entire length and to and through the actuating members of the well tool or tools to be actuated. The apparatus and method block fluid communication between an activating fluid body and a second fluid source within the well across dynamic seals between the actuating members of the well tool during actuation thereof.

The apparatus and method of the present invention also contemplate incorporation of a signal generating means which forms a part of the wall of the tubular conduit portion for selectively generating a signal in response to a predetermined condition which is detectable on the wall of the conduit string or portion. Actuation means are disposed exteriorly of the bore of the production conduit and include an actuating member for performing at least one desired function. An activating body is in direct or indirect communication with the actuating member. Movement prevention means selectively resist movement of the actuating member. Preferably, releasing means are responsive to the signal generating means for releasing the movement prevention means from the actuating member for performance of the desired function or functions, and the apparatus thus prevents direct fluid communication between the activating fluid and the second fluid source across the seals.

A packer which may be incorporated with this invention may be mounted in surrounding relationship to the production tubing or work string and actuated by the downhole apparatus of this invention to sealingly engage the bore wall of the well casing.

The signaling generating means preferably comprises a strain gauge forming a part of the imperforate wall of the production tubing, but may also be a piezo electric crystal light beam, sonic vibratory component, or any other non-magnetic transducer or electronically activated element which generates a signal which is detectable as hereinafter described and contemplated. The strain gauge, or other element, is mounted so as to detect all forms of stress or other physical phenomena (hence, strain) detectable on the wall portion.

In the case of a strain gauge, a first signal may be produced in response to a preselected circumferential tensile stress, a different signal in response to a preselected circumferential compressive stress, or other signals respectively corresponding to the existence of predetermined strain in the wall portion of the production tubing or work string portion to which the strain gauge is affixed.

During the initial run-in of a production tubing and a packer, it is obviously difficult to apply any lasting change in circumferential tension or other stress, in the wall of the production conduit portion to which the strain gauge is affixed. However, variation of the sensed pressure at the location of the strain gauge to a level substantially different than an initial pressure within the tubular conduit will result in a significant change in the strain, with the corresponding generation of a significant change in the resistance characteristics between circumferentially spaced contact points of the strain gauge will be produced, resulting in a significant change in resistance between the same circumferentially spaced contact points of the strain gauge.

On one embodiment of the invention, such changes in average value of the resistance of the strain gauge are detected by a conventional electronic hookup to a microprocessor (shown only schematically in the drawings and not forming a part of the inventive concept per se). The average value changes are amplified to a level sufficient to effect the activation of a stored or other energy actuating mechanism which may take a variety of forms, such as an explosive charge which is fired to generate a high pressure gas, a spring, or a motor, which is then employed to shift a piston or other mechanism, to effect the actuation of a well tool, for example, a packer.

The control signal could also be employed to operate one or more solenoid valves to derive energy from the hydrostatic annulus pressure to effect the opening or closing of a testing valve or safety valve.

Lastly, and in accordance with this invention, the control signal can be employed to function as a latch release means for a downhole tool actuating piston disposed in a chamber formed exteriorly of the production conduit and containing pressurized gas either generated in-situ, or stored, or explosively created, urging the piston or other activating mechanism in a tool operating direction. So long as the latch mechanism is engaged with the piston, or the like, the tool is not operable, but the control signal is applied to a solenoid to release the latch, thus releasing the piston for movement to effect the actuation of the tool.

As will be later described, such tool may conveniently comprise a packer which is set by the release of the latch in response to a predetermined change in strain in that portion of the production conduit on which the strain gauge is mounted.

When the packer is set, other signals may be generated for various useful purposes. The setting of the packer will, for example, effect a substantial reduction in the axial tensile stress existing in the conduit above the packer. If the strain gauge is so located, it will generate a significant in-situ signal which can be sent to the surface by an acoustic or radio frequency transmitter to inform the operator that the packer or other downhole tool has indeed been set, or activated.

Alternatively, and particularly when the production tubing or work string is being initially installed, the second signal generated by the strain gauge upon or at any time subsequent to the setting of the packer, can be utilized to effect the firing of a perforating gun or other activation of a second or auxiliary well tool. However, it is sometimes desirable that the perforating gun be fired when the pressure conditions in the production zone below the packer are in a so-called "underbalanced" condition, where the fluid pressure within the production conduit is significantly less than the annulus fluid pressure. This reduction in production tubing pressure may be conventionally accomplished by running the production tubing or work string into the well dry by having a closed valve at its lower end, or by swabbing any fluids existing in the production tubing or work string from the well after the packer is set. This procedure has many variables and such procedure and variables are well known to those skilled in the art. In either event, the resulting change in circumferential compressive stress will result in the strain gauge producing a distinctive signal which may be employed to effect the firing of the perforating gun.

After the firing of the perforating gun, it is common to kill the well, unset the packer, retrieve the work string and run into the well a permanent completion hook-up, including, for example, a safety valve, a packer, a production screen, or ported sub, and the like. The production string is positioned in the well so as to place the screen, or ported sub, to lie adjacent the newly formed perforations in the casing, thus permitting production fluid to flow through the screen or ported sub and into the production tubing.

If a test valve is incorporated in the lower portion of the production tubing, it can be maintained in a closed position by a spring or other means, and conventional instrumentation disposed within the production tubing can effect a measurement of the formation pressure. An increase in fluid pressure within the production tubing over the annulus fluid pressure will result in a circumferential compressive stress in the strain gauge accompanied by a significant change in the resistance of the strain gauge in the circumferential direction. This signal can be employed to effect the opening of the testing valve or safety valve as the case may be, by a solenoid winding disposed in surrounding relation to the production tubing. Such solenoid operated testing valves and/or safety valves are well known in the art.

The electrical energy for operating the various solenoids heretofore referred to is preferably supplied by a downhole battery pack which is disposed in the annulus surrounding the production tubing string.

Those skilled in the art will recognize that the actuation of one or a plurality of downhole well tools by downhole energy sources in response to a pre-determined condition detectable on a portion of the wall of an imperforate production or work tubing string portion provides an unusually economical, yet highly reliable system for effecting the remote operation of downhole well tools and for blocking fluid communication between an activating fluid body and a second fluid source within the well across dynamic seals between actuating members of a well tool during the actuation procedure.

Further advantages of the invention will be readily apparent to those skilled in the art from the following detailed description, taken in conjunction with the annexed sheets of drawings.

DESCRIPTION OF THE PREFERRED EMBODIMENTS

Figure 1:
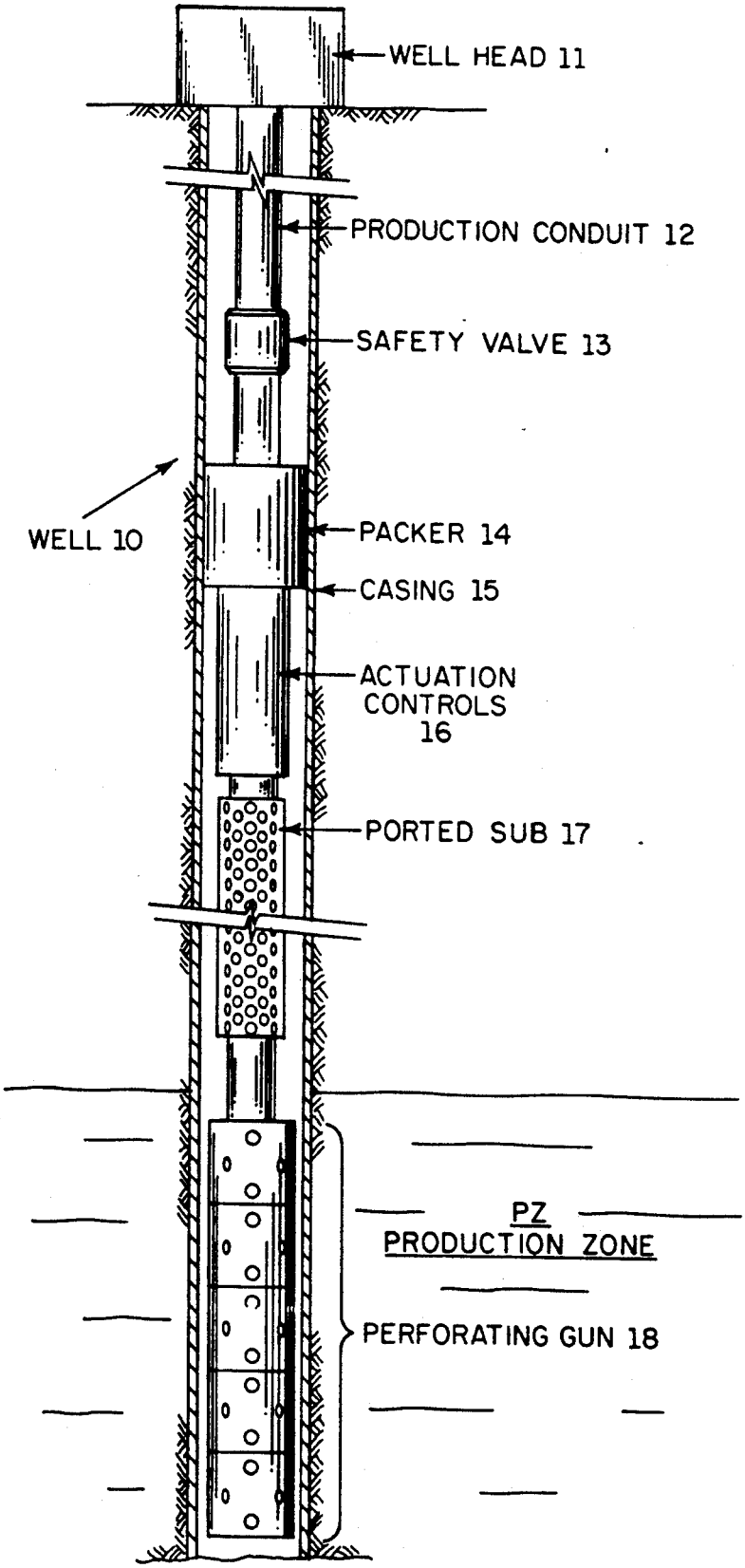
FIG. 1 is a schematic, vertical sectional view of a well showing a tubing string incorporating a packer, a safety valve, and a perforating gun positioned in the well subsequent to setting of the packer in response to signals generated by a strain gauge forming a portion of the wall of the production conduit.

Now, with reference to the drawings, and, in particular, FIG. 1, there is shown schematically at the top thereof a wellhead 11, conventional in nature, securing a production conduit 12 extending from the lowermost facial side of the wellhead 11 into a subterranean well 10. The production conduit 12 may be production tubing, or a tubular work string, conventional in nature, and well known to those skilled in the art.

The production conduit 12 is shown as carrying a safety valve 13, which may take the form of a ball, flapper, or other valve construction known to those skilled in the art. A packer 14 is schematically illustrated as being disposed on the production conduit 12 below the safety valve 13, with the conduit 12 extending in the well 10 and within casing 15.

Actuation controls 16, depicted in more detail in FIGS. 2B, 2C, 3B, and 3C, are disposed on the well conduit 12 below the packer 14.

As shown, a well production screen 17 is shown on the conduit 12 above a perforating gun 18. It will be appreciated by those skilled in the art that, in lieu of a screen 17, a simple ported sub may be utilized for introduction of production fluids from the production zone PZ of the well 10 into the annular area between the casing 15 and production conduit 12, thence interiorly of the conduit 12 to the top of the wellhead 11.

The perforating gun 18 is shown as a tubing-conveyed perforating gun which is well known to those in well completion technology.

Figure 2A:
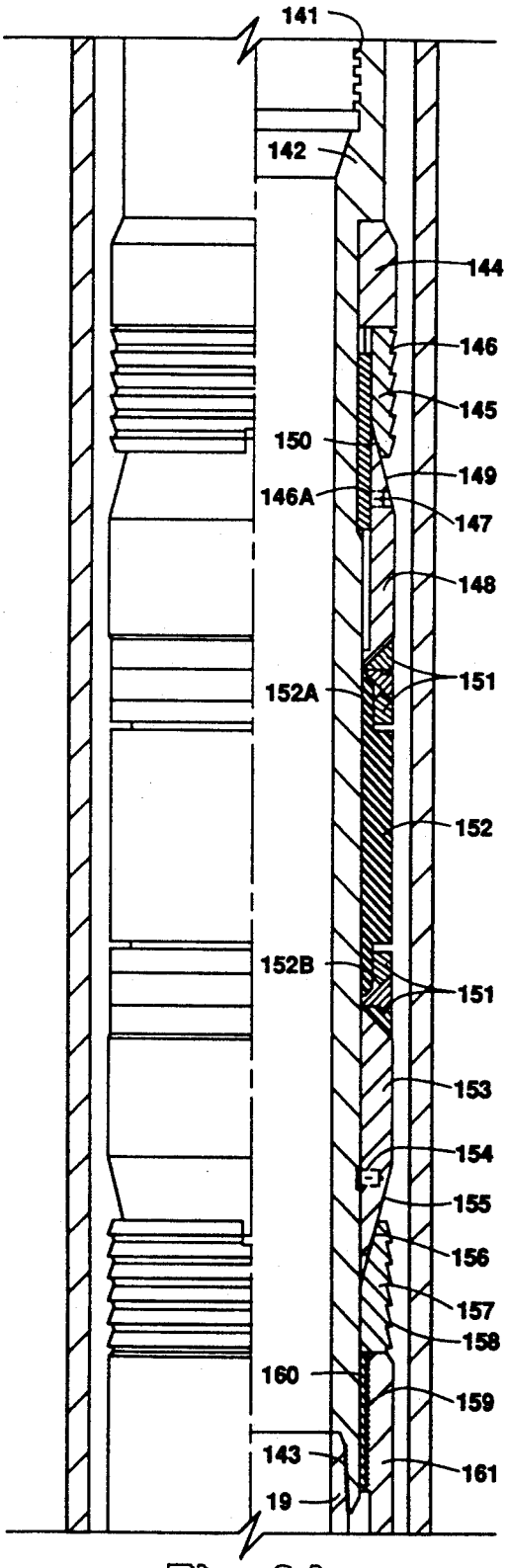
FIGS. 2A, 2B and 2C collectively represent an enlarged scale, vertical sectional view of the unset packer and packer actuating mechanism, including a schematic showing of the strain gauge and microprocessor employed for setting the packer and actuating other, well tools.
Figure 2B:
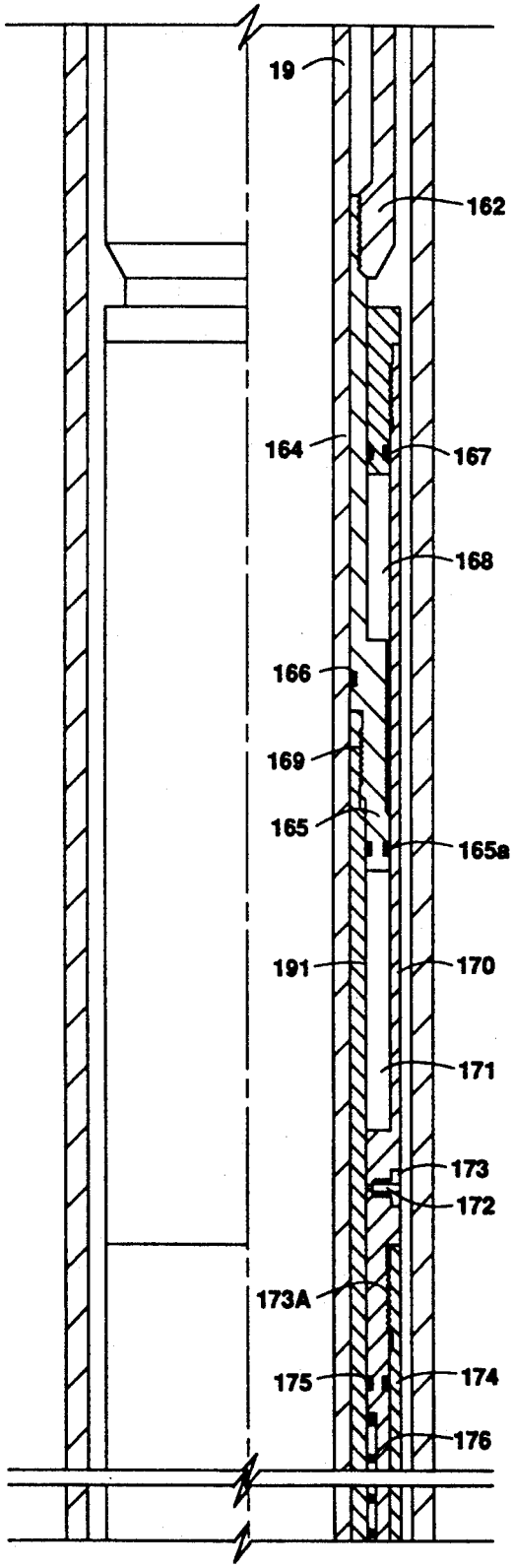
Figure 2C:
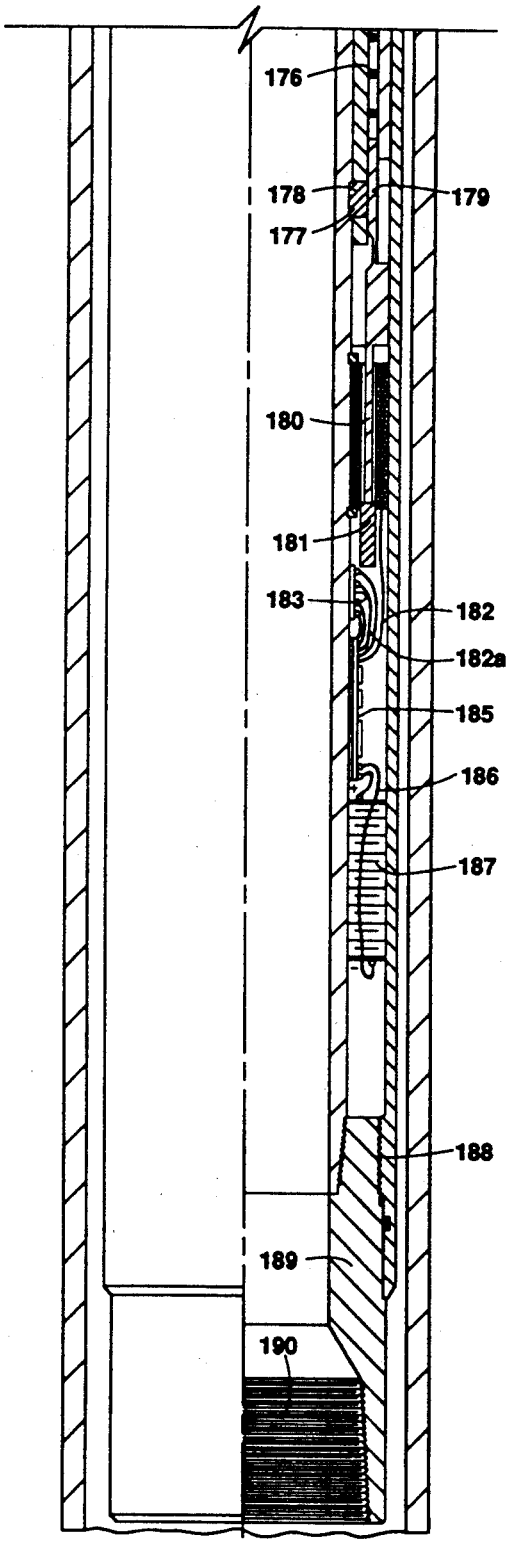

Now, with reference to FIGS. 2A, 2B, and 2C, the apparatus of the present invention is shown disposed within the casing 15 with the packer 14 being positioned in unset mode. The production conduit 12 extends to a conduit member, or body 142, having threads 141 at its uppermost end for securement to companion threads in the lowermost section of the production conduit 12 thereabove.

Figure 3A:
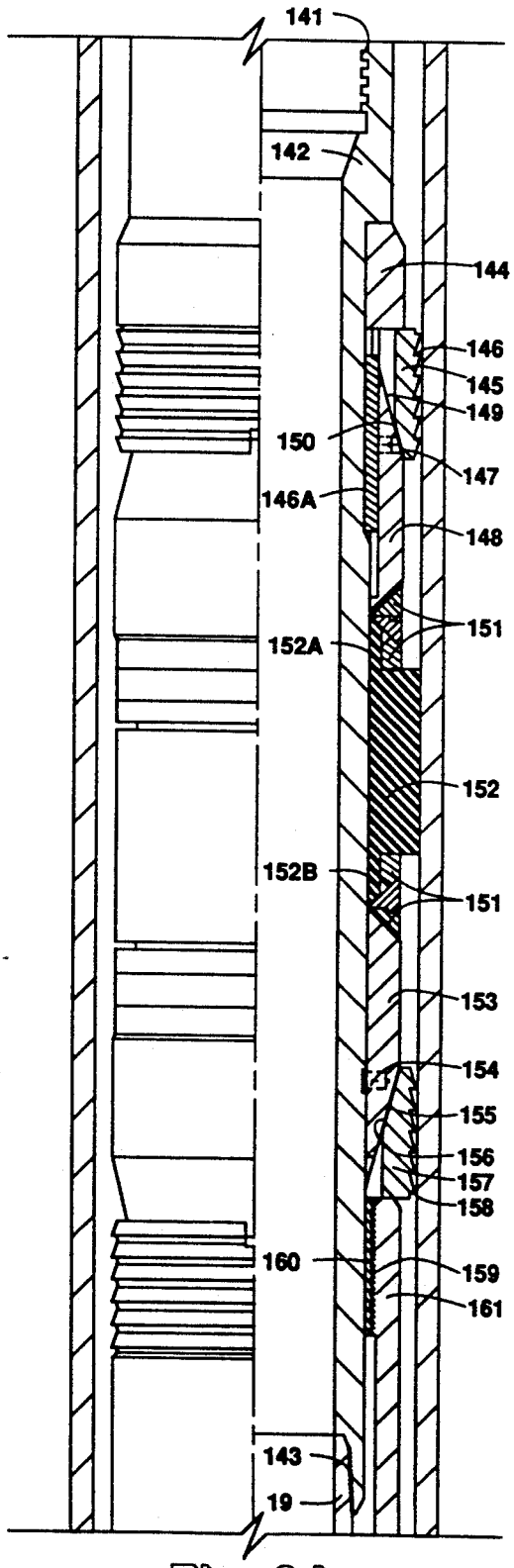
FIGS. 3A, 3B and 3C respectively correspond to FIGS. 2A, 2B and 2C but show the position of the packer and its actuating mechanism after the setting of the packer has been accomplished.
Figure 3B:
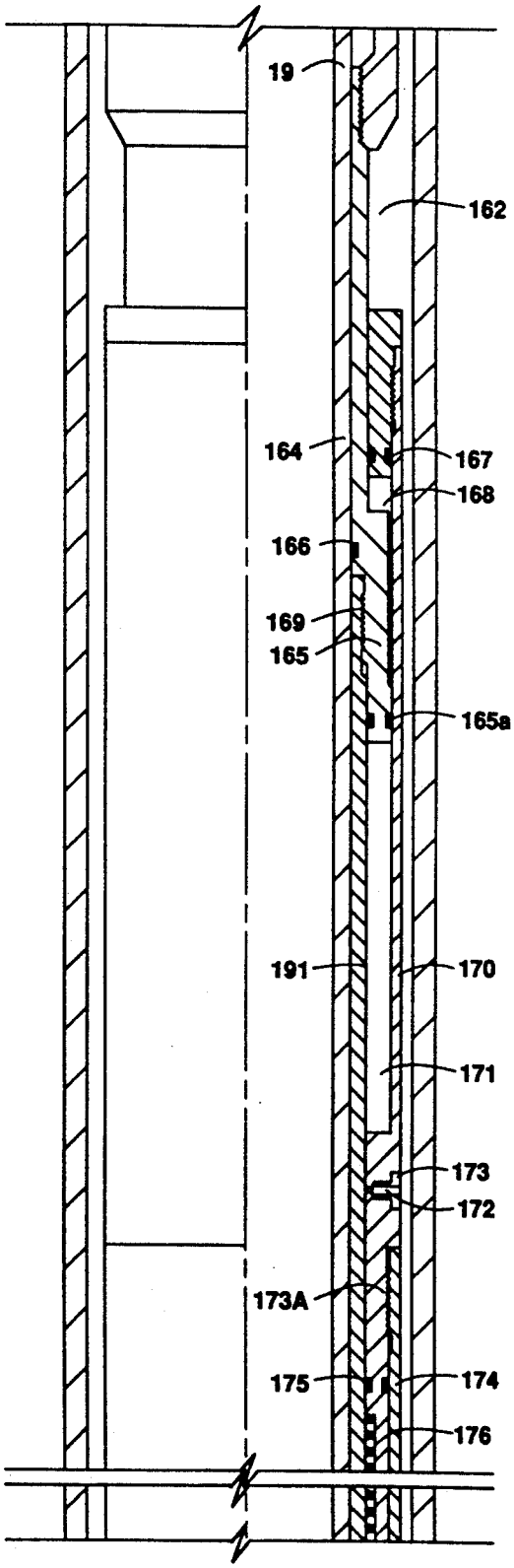
Figure 3C:
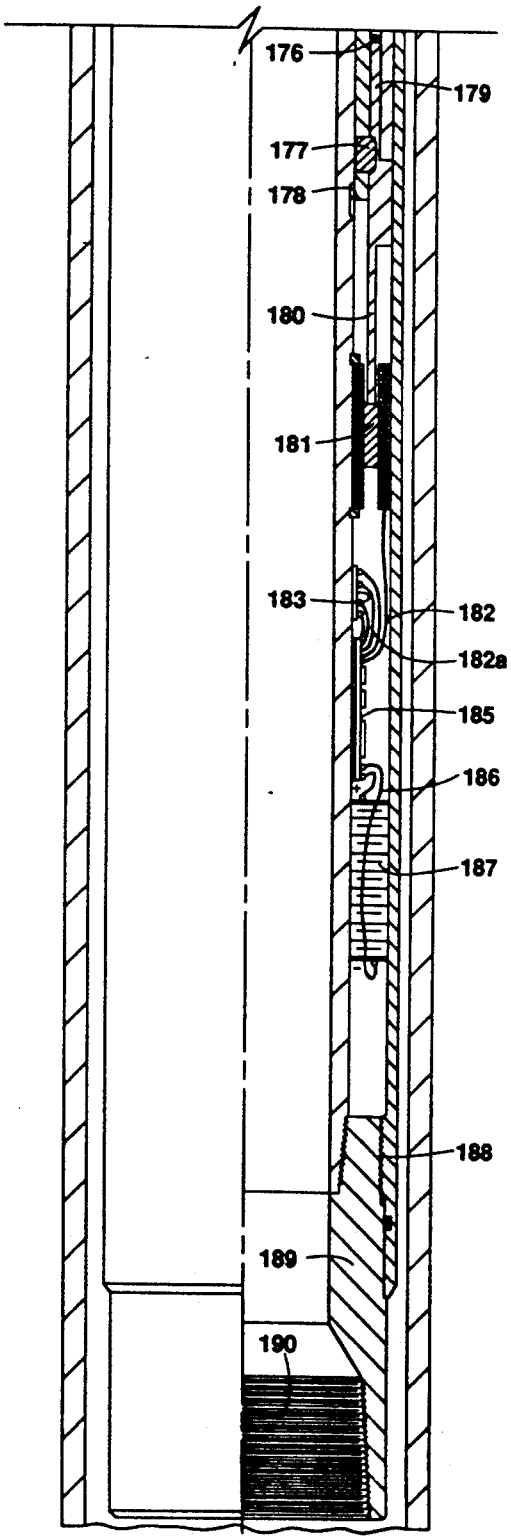

A securing ring 144 is carried around the exterior of the body 142 for containment of the uppermost end of a series of slip members 145 having contoured teeth 146 circumferentially subscribed exteriorly therearound for embedding and anchoring engagement of the packer 14 relative to the casing 15 when the tool is shown in the set position, as in FIGS. 3A, 3B, and 3C.

The slips 145 have a lower facing beveled slip ramp 150 for companion interface with a ramp 149 carried at the uppermost end of an upper cone member 148 being carried exteriorly around a support member 146, with the upper cone 148 secured to the support 146 by means of shear pin members 147. Thus, the slips are secured in retracted position relative to the cone 148, prior to setting actuation.

Below the cone 148 is a series of non-extrusion seal members which may comprise a combination of metallic and elastomeric seal assemblies, the seal system 151 being carried exteriorly around the cone 148. The system 151 is affixed around the exterior of the body 142 and at the uppermost end of a conventional elastomeric seal element 152 having an upper inward li **152*a* extending interiorly of the seal system 151**.

At the lowermost end of the seal element 152 is a lower lip **152*b* of similar construction as the lip 152*a*. Exteriorly of the lip 152*b* is a second, or lower, non-extrusion seal system 151 which, in turn, is carried around its lowermost end on the uppermost beveled face of the lower cone element 153 which is shear pinned at pin 154 to the body 142**.

A lower ramp 155 is carried exteriorly around the cone 153 and contoured interiorly at its lowermost tip for companion interengagement with a similarly profiled slip ramp 156 around the uppermost interior surface of the slip element 157. The lower slip 157 has teeth 158 which are similar in construction to the teeth 146 on the uppermost slip rings or elements 145 for interengagement to anchor the device relative to the casing member 15 when the tool is in the set position, as shown in FIG. 3A.

Below the lowermost slip ring 157 is a body lock ring 160 which is housed exteriorly of the body 142 and interior of an outer ring 162 having ratchet threads 159 thereon. The purpose of the body lock ring 160 and ratchet threads 159 is to lock the setting energy resulting from the setting actuation of the packer 14 into the upper and lower slips 145, 157, and to thus assure sealing integrity of the seal element 152 relative to the casing 15. The ratchet teeth 159 are, of course, one way acting, but could be provided in a configuration which would permit resetting of the device subsequent to unsetting.

At the lowermost end of the body element 142 is a series of threads 143 for securing the body 142 to the tubular member 19 extending to the actuation controls 16, shown in FIGS. 2B and 2C.

Now referring to FIGS. 2B and 2C, the actuating sleeve 162 extends to the outer ring portion 161 at its uppermost end and is secured at threads 163 to a piston mandrel 164. The piston mandrel 164 has a series of elastomeric or metallic seal members 166 to prevent fluid communication between the piston mandrel 164 and the member 19.

At the lowermost end of the piston mandrel 164 is an enlarged piston head 165 having seal members **165*a* thereon. The piston mandrel 164 is secured at threads 169 to a lock sleeve 191 which has at its lowermost end (FIG. 2C) a locking dog secured in place within a groove 178 profiled in the member 19 to prevent relative movement between the lock sleeve 191 and the member 19** prior to actuation as discussed below.

Above the piston head 165 is an atmospheric chamber 168 which extends between the seal members 167 and **165*a***.

Below the seal member **165*a* on the piston head 165 is a nitrogen chamber 171. Nitrogen is emplaced in the chamber 171 through the filler passage 172 which is capped at 173** subsequent to the filling procedure which is performed prior to introduction of the apparatus into the well.

A cylinder housing 170 is secured at threads at its uppermost end to the piston mandrel 164 and at threads 173 to an actuator housing 174 there below. The nitrogen chamber 171 is defined between the seals **165*a* in the piston head 165 and a series of similar seals 175 in the cylinder housing 170**.

Housed within the cylinder housing 170 at its uppermost end and the actuator housing is a master control spring 176 carried exteriorly of a spring housing 179.

Below the lowermost end of the spring housing 179 is a non-magnetic solenoid member 180, of conventional construction, which is secured above a ferro-magnetic core member 181. The solenoid member 180 is in communication electronically with the strain gauge 183 through a microprocessor 185 by means of circuit lines 182, 183. The strain gauge 183 is secured to the outer wall 184 of the member 19, such that the given condition on the wall of the conduit member 19 is sensed by the gauge 183.

Below the strain gauge 183 and communicating therewith by electric lines **182*a* is a microprocessor 185 which may be pre-programmed prior to introduction of the apparatus into the well to detect and generate instructions relative to the solenoid member 180 and the strain gauge 183** in known fashion.

A battery 187 provides electrical energy through lines 186 to the microprocessor 185.

The cylindrical housing 170 is secured at threads 188 to a lower sub 189 which, in turn, is secured by threads 190 to another short section of production tubing, or the like, or may be simply bull-plugged and thus defining the lowermost end of the production conduit 12. Alternatively, an auxiliary tool may be disposed below the actuation controls 16, such as the perforating gun 18.

Figure 4A:
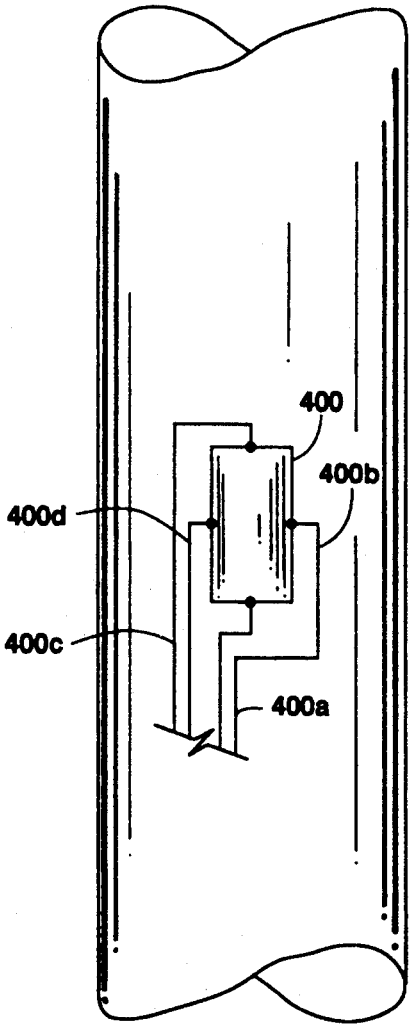
FIGS. 4A and 4B schematically illustrate alternative connections to strain gauges to detect changes in axial and/or circumferential stresses in a production conduit.
Figure 4B:
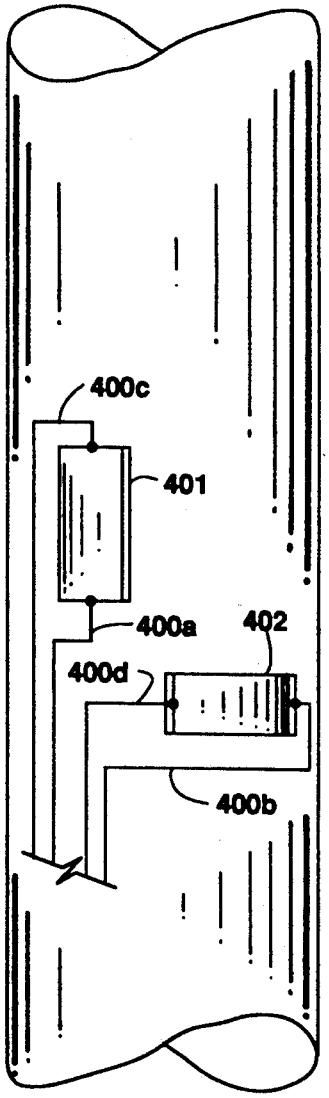

The downhole signal generating means embodying this invention comprises a strain gauge 400 applied to the wall of the production conduit which will change its resistance in response to significant changes in the stresses existing in the conduit wall to which it is attached. Strain gauge 400 may be of rectangular configuration as shown in FIG. 4A with connnectors **400*a*, 400*b*, 400*c* and 400*d* respectively connected to the mid points of each side of the strain gauge 400. Thus connectors 400*a* and 400*c* will detect changes in resistance due to changes in axial stress in the conduit. Connectors 400*b* and 400*c* will detect changes in resistance due to changes in circumferential stress in the conduit. Connectors 400*a*, 400*b*, 400*c* and 400*d* thus provide signal inputs to the microprocessor 410 which will generate an activating voltage for operating a downhole tool, such as the packer 14**.

The second strain gauge 402 is circumferentially secured to the conduit and has connectors **400*b* and 400*d*** secured to its opposite ends to indicate axial stresses in the conduit.

OPERATION

As set forth above, the apparatus of the present invention is run into the well interior of the casing 15 and below the wellhead 11, with the production conduit 12 carrying well tools, such as the safety valve 13, packer 14, screen 17 and perforating gun 18. The actuation controls 16 are shown in FIG. 1 positioned below the packer 14 on the production conduit 12. However, it will be appreciated that such a control 16 may be positioned either above or below the packer 14, or other well tool on the production conduit 12.

When it is desired to set the well packer 14, the production conduit 12 may either be set down, picked up, or rotated, either clockwise or counterclockwise. The microprocessor 185 has been pre-programmed to detect a predetermined sequence of strain caused thereby, which is, in turn, detected by the strain gauge 183. The battery 187 delivers energy power through line 186 to the microprocessor 185 which, in turn, governs the strain gauge 183.

As the strain gauge 183 detects the stresses defined through the production conduit, a signal is sent through line 182 to the magnetic solenoid member 180 which, in turn, actuates a trigger to shift the spring housing 179 such that the locking dog 177 may be removed from the groove 178 of the lock sleeve 191 which, in turn, permits the control spring 176 to act as a booster upon the piston head 165. Accordingly, the energy in the nitrogen chamber 171 moves the piston head 165 against the atmospheric chamber 168 to urge the piston mandrel 164 upwardly and move the sleeve 162 upwardly such that the lower slip 157 moves on the ramp 155 to urge the teeth 158 of the lower slip 157 out into biting engagement with the internal wall of the casing 15. Contemporaneously with such movement, the energy transmitted through the actuation of the piston head 165 is transmitted such that the upper cone 148 moves relative to the upper slips 145 to permit the teeth 146 of the upper slip 145 to engage the casing 15. Correspondingly, the seal element 152 is compressed and the seals 151, 152 move into sealing engagement with the interior wall of the casing 15. Contemporaneously, the lock ring 160 ratchets relative to the threads 159 and the outer ring 161 to secure the packer actuation in place.

It will be appreciated that the actuation controls 16 have a member 19 thereon which is not ported, such that the dynamic seals 165*a*, 166 do not come into fluid communication with the fluid either in the atmospheric chamber 168 or in the interior of the production conduit 12, nor do such seals contact or communicate directly with fluid in the annulus between the casing 15 and the production conduit 12.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus for completing a subterranean well, comprising:

a tubular conduit portion made up within a tubular conduit string of the type extending from a point near the surface of the earth to a remote point downwardly within said well and which is in contact with a fluid source within said well, said tubular conduit portion forming an imperforate wall and defining a central bore radially inward and further defining an exterior surface;

an activating fluid body in communication with, and disposed at least in-part within, said central bore of said tubular conduit portion;

signal generating means including at least one sensor member coupled to said exterior surface of said tubular conduit portion for detecting circumferential stress in said imperforate wall defined by said tubular conduit portion and for producing an output signal corresponding thereto;

a wellbore tool disposed exteriorly of said tubular conduit portion, and including an actuating member for performing at least one desired completion function; and control means responsive to a predetermined output signal from said signal generating means for selectively activating said wellbore tool and causing said actuating member to perform at least one desired completion function.

2. The apparatus of claim 1, wherein the actuating member includes a fluid pressure chamber located exteriorly of said tubular conduit and a piston slidably and sealably mounted in said fluid pressure chamber for performing at least one desired function.

3. The apparatus of claim 2, further comprising.

packing means including a packer for sealing the annulus between said tubular conduit string and said subterranean well; and wherein said piston is slidably and sealably mounted in said fluid pressure chamber and operatively connected to said packing means to set said packer by axial movement of said piston.

4. An apparatus for completing a subterranean wellbore having an imperforate conduit extending from the well surface downwardly into contact with well fluids, the apparatus comprising.

an imperforate tubular body made up within said imperforate conduit in series relation, defining a conduit bore for receipt of fluid;

packing means surrounding said imperforate tubular body;

actuation means including an actuating member for moving said packing means into sealing relation between said imperforate tubular conduit and the subterranean wellbore;

latch means initially restraining said actuation means in an inoperative condition; and sensing means responsive to a predetermined change in circumferential stress in a portion of said imperforate tubular body and for generating a signal to initiate release of sad latching means, said predetermined change in circumferential stress in the portion of said imperforate tubular body being produced by a predetermined conduit bore fluid pressure.

5. An apparatus for completing a subterranean well, comprising:

a tubular conduit portion extendable to a tubular conduit string having an internal bore and having an imperforate wall extending from a point near the surface of the earth to a remote point downwardly within said well and in contact with a fluid source within said well;

electrical signal generating means coupled to said imperforate wall of said tubular conduit portion for selectively generating electrical signals corresponding to circumferential stress detectable on said imperforate wall;

actuation means disposed exteriorly of said internal bore of said tubular conduit portion, said actuation means including an actuating member for performing at least one desired function;

control means responsive to said electrical signals for activating said actuation means to actuate said actuating member for performing at least one desired function;

wherein said electrical generating means includes at least one strain gage mounted exteriorly on said imperforate wall and oriented generally transverse to the longitudinal axis of the tubular conduit string for detecting circumferential stress in said imperforate wall perpendicular to the longitudinal axis of said tubular conduit string; and wherein predetermined values of said electrical signals are produced by a predetermined conduit bore fluid pressure.

6. The apparatus of claim 5, wherein said at least one strain gauge includes a plurality of strain gages mounted in pairs 180 degrees apart at selected circumferential locations on said tubular conduit.

7. A method of operating a downhole tool in a subterranean well having a tubular conduit string with an internal bore, the method comprising the steps of:

providing a tubular conduit portion, which defines an exterior surface and which further defines a central bore radially inward;

coupling said tubular conduit portion to said tubular conduit string to allow communication between said internal bore of said tubular conduit string and said central bore of said tubular conduit portion;

providing an actuating fluid body within said internal bore of said tubular conduit string and said central bore of said tubular conduit portion;

providing a signal generating means and coupling said signal generating means to said exterior surface of said tubular conduit portion for selectively generating a signal corresponding to circumferential stress in said tubular conduit portion;

providing actuation means disposed exteriorly of said coupled tubular conduit string and said tubular conduit portion, said actuation means including an actuating member for performing at least one desired function;

providing means responsive to predetermined change in said signal from said signal generating means for activation said actuation means to actuate said actuating member for performing at least one desired function; and wherein said predetermined change of said signal is produced by fluid pressure of said actuating fluid body in said central bore of said tubular conduit portion.

8. An apparatus for use in performing selected wellbore operations in a subterranean wellbore having wellbore fluids therein, comprising:

a wellbore conduit of selectable length for placement in said subterranean wellbore, having a central bore extending therethrough;

a tubular conduit portion forming a wall having an exterior surface, and which defines a central bore radially inward therefrom;

means for securing said tubular conduit portion at a selected location within said wellbore conduit, allowing communication of fluid between said central bore of said wellbore conduit and said central bore of said tubular conduit portion;

an activating fluid body, in communication with said central bores of said wellbore conduit and said tubular conduit portion, or applying a selectable fluid pressure to said central bore of said tubular conduit portion;

a conveyable wellbore tool carried within said subterranean wellbore on said wellbore conduit and positionable at a selected location within said subterranean wellbore by selective placement on said wellbore conduit, said conveyable wellbore tool being operating in a plurality of operating modes including a pre-actuation running mode of operation and at least one post-actuation mode of operation, being switchable between selective modes of operation in response to a selected actuation signal;

a signal generating member, including at least one sensor member coupled to said exterior of said tubular conduit portion for detecting circumferential stress in said tubular conduit portion caused by elevation of said selectable fluid pressure of said activating fluid body; and a control member responsive to a selected output signal from said signal generating member, for providing said selected actuation signal to said conveyable wellbore tool to switch said conveyable wellbore tool between selected modes of operation of said plurality of operating modes.

9. An apparatus according to claim 8, wherein said wellbore conduit comprises a tubular workstring.

10. An apparatus according to claim 8, wherein said wellbore conduit comprises a tubular wellbore production string.

11. An apparatus according to claim 8, wherein said welibore conduit comprises a tubular string composed of a plurality of mated tubular members, and wherein said tubular conduit portion comprises a tubular member selectively mateable between selected tubular member of said wellbore conduit.

12. An apparatus according to claim 8, wherein said tubular conduit portion forms an imperforate wall which defines said central bore radially inward.

13. An apparatus according to claim 8, wherein said wellbore conduit and said tubular conduit portion together define an imperforate wall which defines a central bore, and which extends from a surface to a selected location within said subterranean wellbore.

14. An apparatus according to claim 8, wherein said means for securing said tubular conduit portion to a selected location within said wellbore conduit comprises at least one threaded coupling.

15. An apparatus to claim 8, wherein said wellbore conduit and said tubular conduit portion maintain said activating fluid body out of fluid communication with said wellbore fluids.

16. An apparatus according to claim 8, wherein said activating fluid body comprises a liquid.

17. An apparatus according to claim 8, wherein said conveyable wellbore tool comprises a wellbore packer which is operable in a plurality of operating modes including a radially-reduced running mode of operation for conveyance within said subterranean wellbore to a selected location, and a radially-expanded packing mode of operation with said wellbore packer in sealing engagement with a selected wellbore surface.

18. An apparatus according to claim 8, wherein said conveyable wellbore tool comprises a perforating gun which is operable in a loaded mode of operation for conveyance within said subterranean wellbore to a selected location and a discharging mode of operation for perforating a selected wellbore surface.

19. An apparatus according to claim 8, wherein said conveyable wellbore tool comprises a valve operable in a plurality of operating modes including a closed position for preventing fluid communication between said wellbore fluids and said activating fluid body, and an open position for allowing fluid communication between said wellbore fluids and said activating fluid body.

20. An apparatus according to claim 8, further comprising at least one additional conveyable wellbore tool, also operable in a plurality of operating modes, wherein said conveyable wellbore tools are sequentially switchable between selected operating modes in response to selected actuation signals.

21. An apparatus according to claim 8, wherein said signal generating member comprises a strain gauge bridge coupled to said exterior surface of said tubular conduit portion for detecting circumferential stress in said tubular conduit portion caused by pressure from said activating fluid body.

22. An apparatus according to claim 8, wherein said signal generating member comprises a strain gauge bridge with four strain gauge sensor elements, each positioned upon said exterior surface of said tubular conduit portion to maximize detection of circumferential stress in said tubular conduit portion which is caused by pressure from said activating fluid body.

23. An apparatus according to claim 8, wherein said control member comprised a programmable unit for receiving sensor data from said signal generating member and providing an actuation signal to said conveyable wellbore tool for switching said conveyable wellbore tool between selected modes of operation.

* * * * *